United States Patent [19]

Pätzold et al.

[11] Patent Number: 4,484,371

[45] Date of Patent: Nov. 27, 1984

[54] FLOOR-SWEEPING MACHINE

[75] Inventors: Dieter Pätzold, Nassau; Alfons Schreiber, Wuppertal; Peter Tiwi, Nassau, all of Fed. Rep. of Germany

[73] Assignee: ITT Industries, Inc., New York, N.Y.

[21] Appl. No.: 422,974

[22] PCT Filed: Jan. 7, 1982

[86] PCT No.: PCT/DE82/00003

§ 371 Date: Sep. 8, 1982

§ 102(e) Date: Sep. 8, 1982

[87] PCT Pub. No.: WO82/02329

PCT Pub. Date: Jul. 22, 1982

[30] Foreign Application Priority Data

Jan. 9, 1981 [DE] Fed. Rep. of Germany ..... 3100496

[51] Int. Cl.[3] ..... A47L 11/08

[52] U.S. Cl. ..... 15/41 R

[58] Field of Search ..... 15/41, 42, 43, 44, 45, 15/48; 16/119, 123, 126, DIG. 24

[56] References Cited

U.S. PATENT DOCUMENTS

| | | | |
|---|---|---|---|
| 2,227,104 | 12/1940 | Parker | 15/41 R |
| 2,233,754 | 3/1941 | Stern | 15/48 |
| 2,502,403 | 3/1950 | Kircher | 15/41 R |
| 3,744,077 | 7/1973 | Smyth | 15/41 R |
| 4,207,641 | 6/1980 | Liebscher et al. | 15/41 R |

FOREIGN PATENT DOCUMENTS

| | | | |
|---|---|---|---|
| 670019 | 1/1939 | Fed. Rep. of Germany . | |
| 1908649 | 9/1970 | Fed. Rep. of Germany | 15/41 R |
| 1191160 | 5/1970 | United Kingdom | 15/41 R |

*Primary Examiner*—Edward L. Roberts
*Assistant Examiner*—Michael Knick
*Attorney, Agent, or Firm*—John T. O'Halloran; Peter R. Ruzek; Mary C. Werner

[57] ABSTRACT

A floor-sweeping machine consisting of a housing with a revolving brush which is mounted rotatably therein and is driven by means of running wheels and which is located between two dirt-collecting spaces, the two dirt-collecting spaces being formed by dirt-collecting containers which can be taken out of the housing upwards, and the dirt-collecting container having a resilient locking device which secures it in its operating position and which can be transferred by hand into its release position, and in which, to make it substantially easier to operate and especially to take out and empty the dirt-collecting containers, the two dirt-collecting containers 24, 25 are connected to one another and have a common top side 27 in which, approximately centrally, there is a part 35 which is to be grasped by the operator and is to be moved to a limited extent in the lifting-out direction and which, when moved in the lifting-out direction, transfers the resilient locking device 36 into the release position.

13 Claims, 9 Drawing Figures

FLOOR-SWEEPING MACHINE

Figure 1:
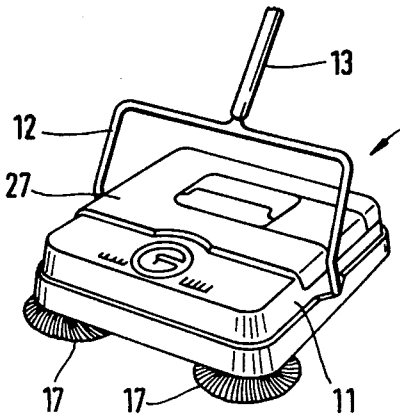

The invention relates to a floor-sweeping machine consisting of a housing with a revolving brush which is mounted rotatably therein and is driven by running wheels and which is located between two dirt-collecting spaces, the two dirt-collecting spaces being formed by dirt-collecting containers which can be taken out of the housing upwards, and the dirt-collecting container having a resilient locking device which secures it in its operating position and which can be transferred by hand to its release position.

In this floor-sweeping machine, when it is used as intended, the dirt is swept, by the revolving brush driven by running wheels, into the particular dirt-collecting space located at the front in the direction of movement. Therefore, as seen by the operator, one dirt-collecting space is located in front of the revolving brush and one dirt-collecting space is located behind the revolving brush. Thus, each dirt-collecting space is formed by a separate dirt-collecting container which can be taken out of the housing upwards by itself. To empty the dirt-collecting containers, the operator must therefore take the two dirt-collecting containers out of the housing of the floor-sweeping machine individually and empty them. To take each dirt-collecting container out of the housing of the floor-sweeping machine, the operator has to loosen two resilient locking devices provided on opposite sides of the dirt-collecting container. It is consequently very complicated to take out the dirt-collecting containers and empty them.

To make it easier to take out the separate dirt-collecting containers, therefore, the locking devices have already been connected to one another by means of a clip which spans the dirt-collecting container, so as to transfer the two locking devices into the release position by pulling up this clip. However, the surface of the dirt-collecting container is impaired and the space required increased by the use of this clip engaging over the dirt-collecting containers.

The object on which the invention is based is to provide a floor-sweeping machine of the type explained in the introduction, in which such disadvantages are avoided and it is made substantially easier to operate it and especially to take out and empty the dirt-collecting containers.

This object is achieved, according to the invention, due to the fact that the two dirt-collecting containers are connected to one another and have a common top side in which there is, approximately in the centre, a part which is to be grasped by the operator and is to be moved to a limited extent in the lifting-out direction and which, when moved in the lifting-out direction, transfers the resilient locking device into the release position. By combining the two dirt-collecting containers into a constructional unit, the operator can, in a simple way, take the dirt-collecting containers out of the housing of the floor-sweeping machine together in one operation and empty them. At the same time, it is especially simple to take out and insert the two combined dirt-collecting containers.

A recess can be shaped in the common top side of the two dirt-collecting containers connected to one another, and located in this recess is a pivoting lever which covers the recess with the exception of an engagement orifice and which forms the part movable in the lifting-out direction. The part movable in the lifting-out direction is thus formed by a pivoting lever which is provided in a recess in the top side of the dirt-collecting container, so that, in the operating position, the pivoting lever does not project above the top side of the dirt-collecting container.

The pivoting lever can have an approximately U-shaped design, the crown part of which is made plate-shaped and covers the recess with the exception of an engagement orifice and is to be gripped underneath with the operator's fingertips, whilst the two legs of the approximately U-shaped pivoting lever engage through the upper wall of the dirt-collecting container and are mounted pivotably about a horizontal axle on the underside of the upper wall by means of their free ends. As a result, the recess provided in the top side of the dirt-collecting container is covered in a simple way by the plate-shaped crown part of the pivoting lever, with the exception of an engagement orifice, so that the operator can grip with the fingertips under the plate-shaped crown part of the pivoting lever and lift it in the lifting-off direction of the dirt-collecting container, and, at the same time, the locking device is transferred into its open position as a result of this lifting. The two legs of the approximately U-shaped pivoting lever are mounted pivotably on the inner side of the upper wall of the dirt-collecting container, so as to permit the pivoting movement of the pivoting lever.

The two legs of the approximately U-shaped pivoting lever can be formed by webs projecting vertically downwards and can be shaped on the underside of the plate-shaped crown part. By shaping the two webs forming the legs and projecting vertically downwards on the underside of the plate-shaped crown part, a strong construction capable of withstanding all loads is obtained.

Bearing journals can be shaped on the two legs of the approximately U-shaped pivoting lever at their free ends and on the sides facing one another, and these bearing journals engage in bearing bores of wall parts shaped on the upper wall of the dirt-collecting container and projecting downwards. As a result, the pivoting lever is mounted pivotably, in a reliable way, on the wall of the dirt-collecting container.

The pivoting lever, which is pivotable to a limited extent, can, in the basic position, rest by means of a portion of the crown part against the top side of the upper wall of the dirt-collecting container and, in the swung-up position, it can rest by means of the legs against the underside of the upper wall of the dirt-collecting container. Because of this, reliably acting limit stops are assigned to the pivoting lever in a simple way.

The resilient locking device securing the dirt-collecting container in its operating position can be formed by a spring wire which is located on the underside of the upper wall of the dirt-collecting container, extends parallel to the pivot axis of the pivoting lever, engages into appropriate cut-out portions of the housing by means of its two ends projecting out from the side walls of the dirt-collecting container and, in the central region, has a U-shaped arc formed by angled portions for the resilient inward movement of the ends projecting out from the side walls of the dirt-collecting container. As a result of resilient compression of the two legs of the U-shaped arc provided in the central region, the free ends of the spring wire can therefore be pulled inwards, so that the free ends of the spring wire which engage into appropriate cut-out portions of the housing are transferred into their release positions. Since the U-shaped arc provided in the central region is also formed from the spring wire, the spring wire automatically returns to the operating position.

The crown part of the approximately U-shaped pivoting lever can have on its underside two projections which rest against the outer sides, facing away from one another, of the two pivoting levers of the U-shaped arc of the spring wire and which have sloping faces. Thus, when the pivoting lever is swung up, the two legs of the U-shaped arc of the spring wire are compressed by means of these two projections having sloping faces, so that the locking device is transferred into the release position.

The clear distance between the sloping faces of the two downwardly directed projections can decrease downwards. As a result, the two legs of the U-shaped arc of the spring wire are compressed in a simple way when the pivoting lever is swung up.

The two downwardly directed projections can have, at their free ends, end stops for the spring wire which are formed by extensions directed toward one another. By means of these end stops for the spring wire, the spring wire is prevented from inadvertently jumping off from the downwardly directed projections.

The spring wire forming the resilient locking device can have, at its two free ends, angled portions which are directed obliquely downwards and inwards and which merge into angled portions directed inwards. As a result of the angled portions directed obliquely downwards and inwards at the free ends of the spring wire, simple insertion of the dirt-collecting containers into the housing of the floor-sweeping machine is guaranteed, since the angled portions directed obliquely downwards and inwards act as sloping faces which strike against the edges of the housing cavity, so that when the dirt-collecting container is pressed into the housing of the floor-sweeping machine the ends of the spring wire are pressed inwards.

Figure 2:
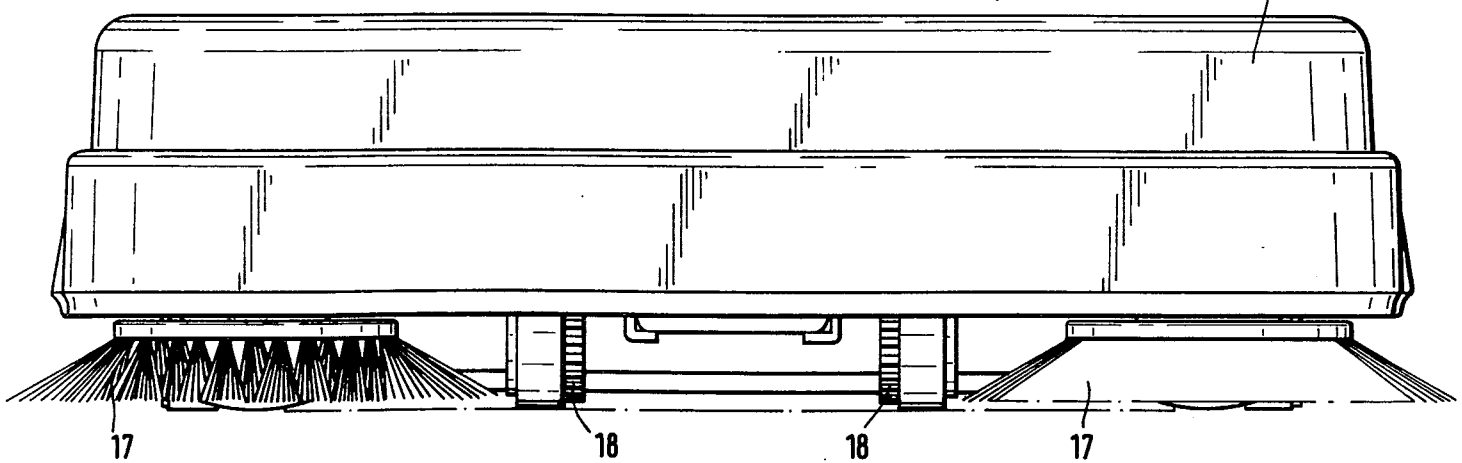
Figures 3, 5:
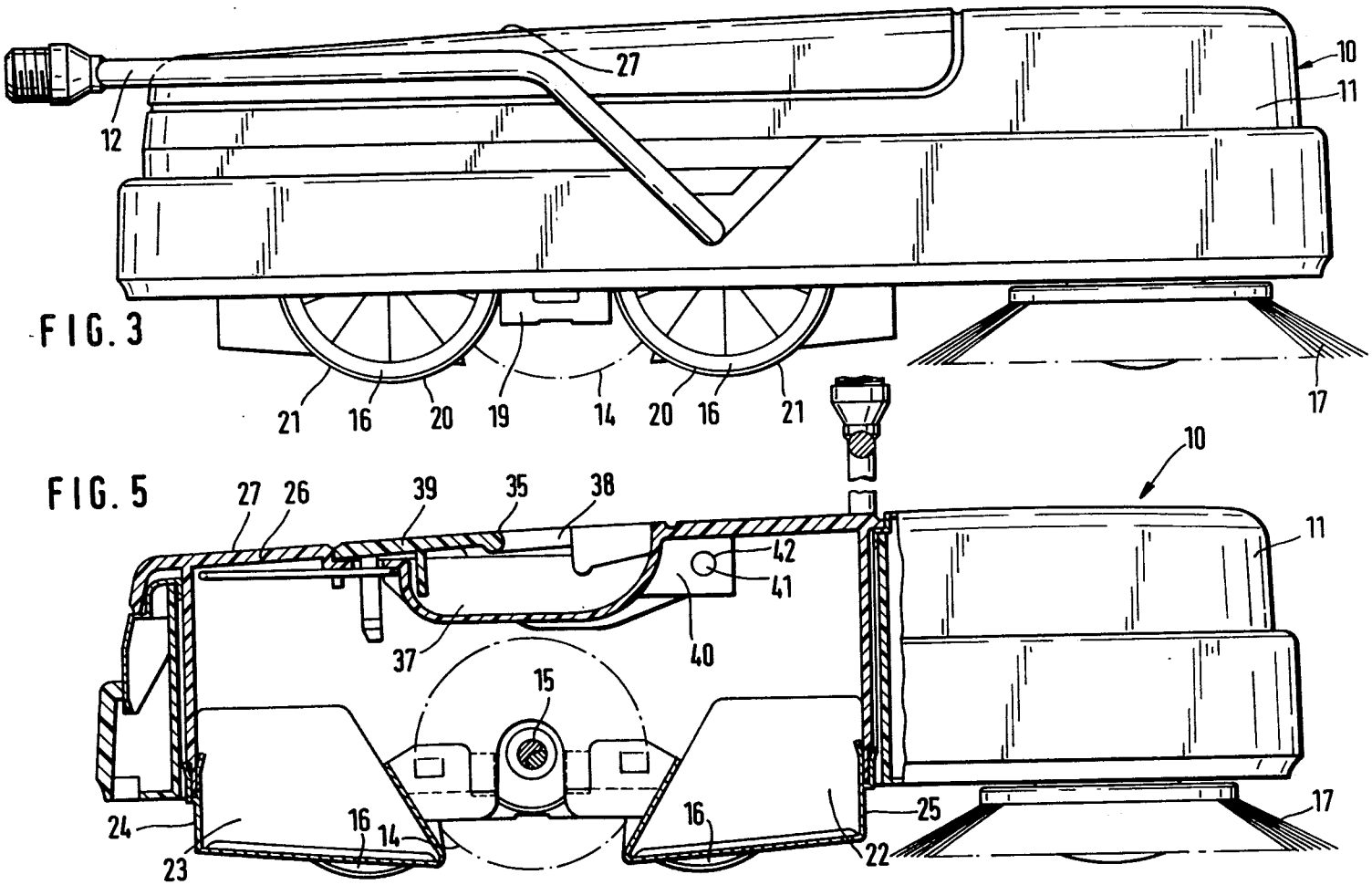
Figure 4:
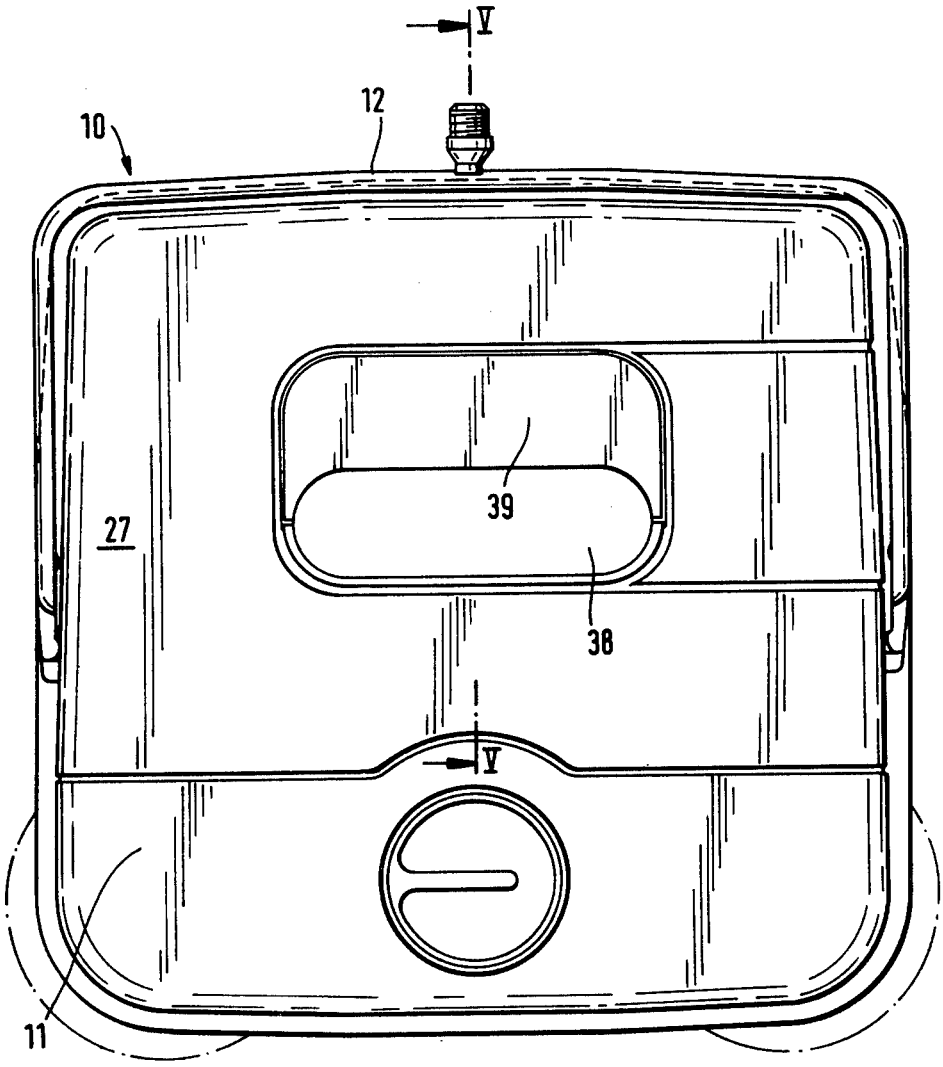
Figure 6:
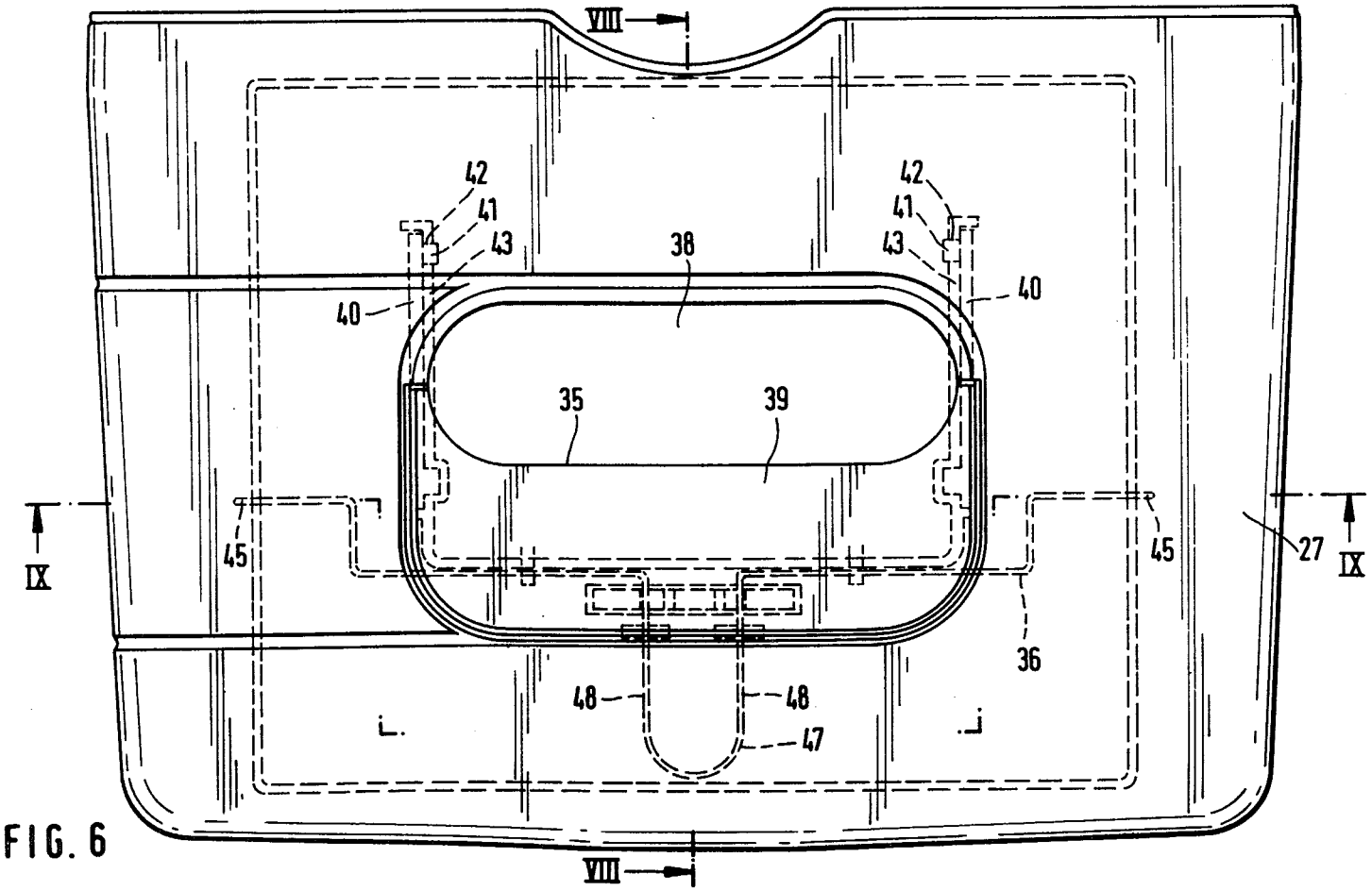
Figure 7:
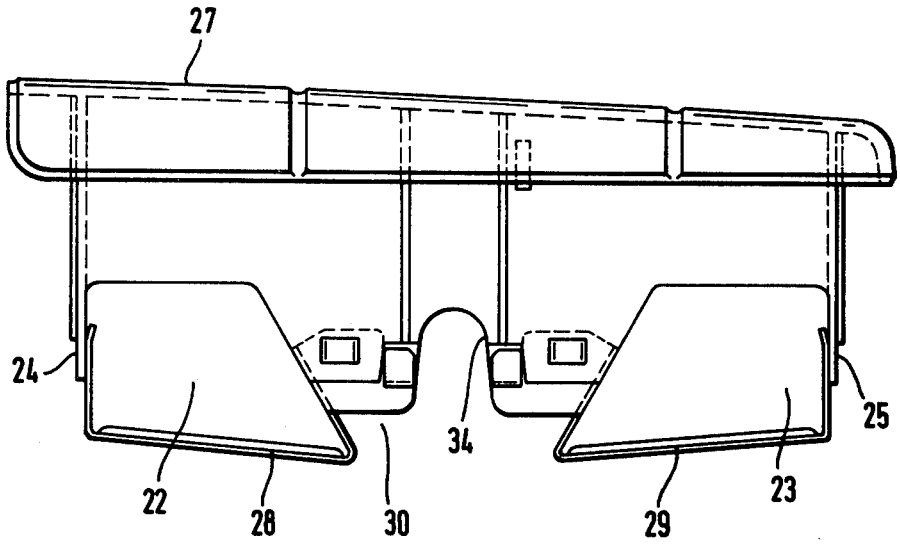
Figure 8:
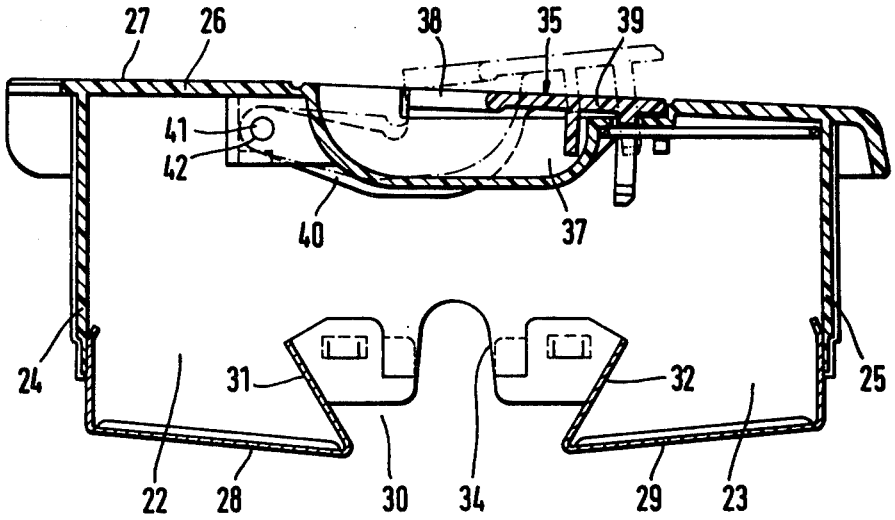
Figure 9:
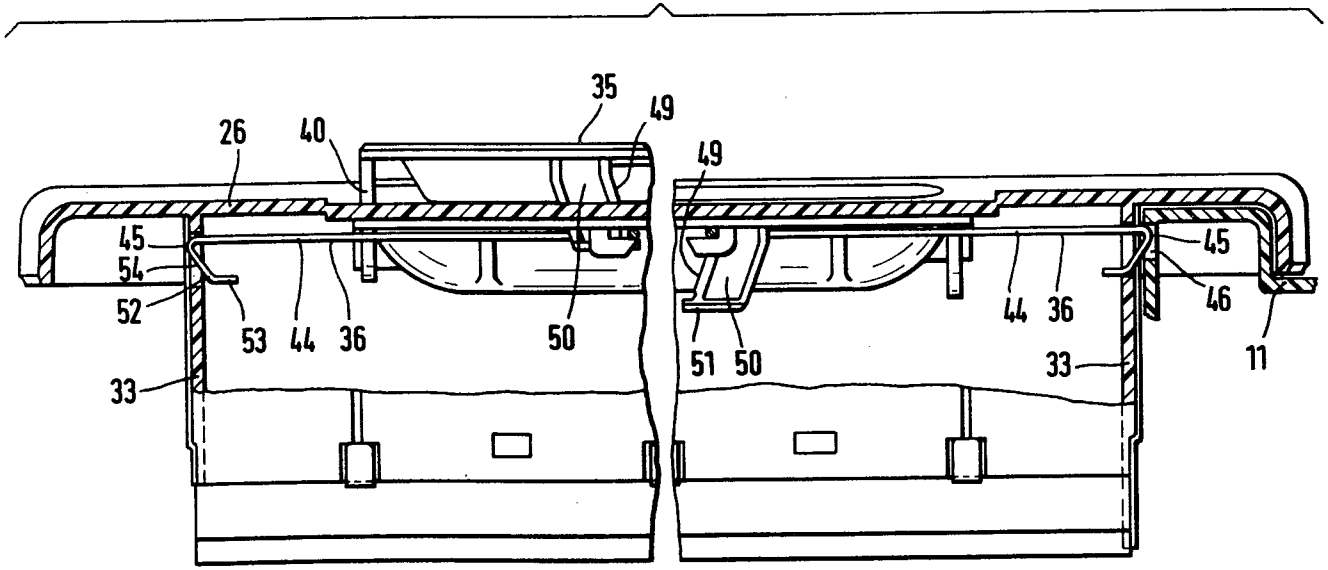

The invention is illustrated in an exemplary embodiment in the drawing, and in this:

FIG. 1 shows, in a diagrammatic representation, a floor-sweeping machine according to the invention, FIG. 2 shows the floor-sweeping machine in a front view, FIG. 3 shows the floor-sweeping machine in a side view, FIG. 4 shows the floor-sweeping machine in a top view, FIG. 5 shows a section along the line V—V of FIG. 4, FIG. 6 shows the dirt-collecting container in a top view, FIG. 7 shows the dirt-collecting container in a side view, FIG. 8 shows a section along the line VIII—VIII of FIG. 6, FIG. 9 shows a section along the line IX—IX of FIG. 6.

The floor-sweeping machine 10 illustrated in the drawing consists of a housing 11. The outer side of the housing 11 serves for receiving a stick fork 12 to which is fastened, in turn, a stick-like handle 13 for moving the floor-sweeping machine to and fro over the floor to be cleaned. On the inside of the appliance, the housing 11 serves for receiving sweeping brushes and the running wheels serving for moving the appliance over a floor surface and for driving the sweeping brushes. To pick up dirt from the floor to be cleaned with the floor-sweeping machine, there is, first of all, a revolving brush 14 which extends transversely to the envisaged direction of movement. To rotate the revolving brush 14 with respect to the floor to be cleaned, pinions, not shown in any more detail, are assigned to the revolving brush at the ends of the shaft 15 and are connected operatively to running drive wheels 16 by friction. The running drive wheels 16 are mounted in the housing 11 in pairs.

Since the revolving brush 14 can work with a sweeping action only up to a certain distance from the side-wall regions of the floor-sweeping machine 10, additional brushes 17 are provided for covering the side-wall regions, and by means of these it is also possible to cover the side region located outside the effective range of the revolving brush 14, as a result of which complete cleaning of the floor even along steps and walls and in corner regions becomes possible.

In the exemplary embodiment illustrated, an additional brush 17 is located in each of the front corner regions of the floor-sweeping machine, in such a way that they are rotatable about a substantially vertical axis and, with their bristle rim arranged in the form of a cup, that is to say radially outwards and downwards, overlap the effective range of the revolving brush 14, on the one hand, and the side-wall and front-wall region of the housing 11, on the other hand. For the purpose of rotation effective for sweeping, the two additional brushes 17 are drive-coupled to running drive wheels 18 located between them.

For the rotatable mounting of the revolving brush 14 in the housing 11, there are two bearing clasps 19 which engage respectively on the ends of the revolving brush 14. The bearing clasp 19 is formed by an approximately U-shaped clamp made of spring steel and can be attached frictionally by means of the two legs of the U-shaped clamp onto a downwardly directed wall part of the housing 11. By means of these two bearing clasps 19, the revolving brush 14 is retained in the housing 11 so that it can be fitted and removed simply.

As already explained, two running drive wheels 16 are assigned to each of the two pinions of the revolving brush 14. Of the running drive wheels 16 arranged in pairs, one running drive wheel 16 is provided in front of the revolving brush 14 and the other running drive wheel 16 behind the revolving brush 14. The running drive wheels 16 have a tread 21 formed by an attached rubber ring 20, and this tread 21 presses against the pinion of the revolving brush 14 so that the running drive wheels 16 are drive-coupled to the pinion of the revolving brush. Consequently, when the running drive wheels 16 rotate, there is rotation of the revolving brush 14. Since the running drive wheels 16 have a larger diameter than the pinions of the revolving brush, the revolving brush rotates at a higher speed. Since the running drive wheels 16 are rotated in different directions of rotation when the floor-sweeping machine is moved to and fro as intended, the revolving brush 14 also rotates in different directions of rotation.

Two dirt-collecting spaces 22 and 23 are assigned to the revolving brush 14. As seen by the operator, the dirt-collecting space 22 is located behind the revolving brush 14 and the dirt-collecting space 23 in front of the revolving brush 14. When the floor-sweeping machine is pushed to and fro as intended, the dirt is swept from the floor to be cleaned into the particular dirt-collecting space 22 or 23 located at the front in the direction of movement.

The two dirt-collecting spaces 22, 23 are formed by dirt-collecting containers 24, 25 which are closed on all sides with the exception of a dirt throw-in orifice facing the revolving brush 14.

The two dirt-collecting containers 24 and 25 are connected to one another to form a constructional unit. Consequently, the two dirt-collecting containers 24 and 25 can be taken as a single part out of the housing 11 of the floor-sweeping machine. It is therefore very simple to empty the dirt-collecting spaces 22, 23 since, for emptying, only one part has to be taken out of the housing 11 of the floor-sweeping machine 10.

The two dirt-collecting containers 24 and 25 connected to one another have a common upper wall 26, the outer side of which forms, at the same time, the top side 27 of the two dirt-collecting containers 24, 25. The top side 27 of the two dirt-collecting containers 24, 25 also forms, at the same time, part of the top side of the floor-sweeping machine 10. This is evident especially in FIG. 4. The bottom walls 28, 29 of the two dirt-collecting containers 24, 25 are located at a distance from one another because of an orifice 30 for engagement of the revolving brush 14. At the edges of the bottom walls 28, 29 facing the revolving brush there are introduction slopes 32 for throwing in the dirt. The common side walls 33 of the two dirt-collecting containers 24, 25 have, in the region of the orifice 30, cut-out portions 34 for attachment onto the revolving brush.

In the common top side 27 there is, approximately in the centre, a part 35 which is to be grasped by the operator and is to be moved to a limited extent in the lifting-out direction and which, when moved in the lifting-out direction, transfers a resilient locking device 36 into the release position. A recess 37 is shaped in the common top side 27 of the two dirt-collecting containers 24, 25 connected to one another, and located in this recess is a pivoting lever 35 which covers the recess 37 with the exception of an engagement orifice 38 and which forms the part movable in the lifting-out direction. The pivoting lever 35 forming the part movable in the lifting-out direction is therefore located in the recess 37 and does not project from the top side 27.

As is evident especially in FIG. 6, the pivoting lever 35 has an approximately U-shaped design, the crown part 39 of which is made plate-shaped and covers the recess 37 with the exception of a engagement orifice 38. The plate-shaped crown part 39 of the pivoting lever 35 is to be gripped underneath by the operator's fingertips through the engagement orifice 38. The two legs 40 of the approximately U-shaped pivoting lever 35 engage through the upper wall 26 of the two dirt-collecting containers 24, 25 and are mounted pivotably about a horizontal axle 41 on the underside of the upper wall 26 by means of their free ends. Here, the two legs 40 of the approximately U-shaped pivoting lever 35 are formed by webs projecting vertically downwards and are shaped on the underside of the plate-shaped crown part 39.

Bearing journals 42 are shaped on the two legs 40 of the approximately U-shaped pivoting lever 35 at their free ends and on the sides facing one another, and these bearing journals engage in bearing bores of downwardly projecting wall parts 43 shaped on the upper wall 26 of the dirt-collecting containers 24, 25.

In the basic position, the pivoting lever 35, which is pivotable to a limited extent, rests by means of a portion of the crown part 39 against the top side 27 of the upper wall 26 of the dirt-collecting containers 24, 25. In the swung-up position, the legs 40 rest against the under side of the upper wall 26 of the dirt-collecting containers 24, 25. As a result, stops for limiting the pivoting of the pivoting lever 35 are provided by means of parts which are present in any case.

The resilient locking device 36 securing the two combined dirt-collecting containers 24, 25 in the operating position is formed by a spring wire 44 which is located on the under side of the upper wall 26 of the dirt-collecting containers 24, 25, extends parallel to the pivot axle 41 of the pivoting lever 35 and engages into appropriate cut-out portions 46 of the housing 11 by means of its two ends 45 projecting out from the side walls 33 of the dirt-collecting containers 24, 25. The spring wire 44 has, in its central region, a U-shaped arc 47 formed by angled portions for the resilient inward movement of the ends 45 projecting out from the side walls 33 of the dirt-collecting containers 24, 25. The crown part 39 of the approximately U-shaped pivoting lever 35 has on its under side two projections which rest against the outer sides, facing away from one another, of the two legs 48 of the U-shaped arc 47 of the spring wire 44 and which have sloping faces 49. The clear distance between the sloping faces 49 of the two downwardly directed projections 50 decreases downwards. Consequently, when the pivoting lever 35 is pulled up, the two legs 48 of the U-shaped arc 47 of the spring wire 44 are pressed resiliently towards one another by the sloping faces 49 of the projections 50, so that the ends 45 of the spring wire 44 are pulled inwards and are free from the cut-out portions 46 of the housing 11. In this way, the locking device 36 is transferred into the release position so that the two combined dirt-collecting containers 24, 25 can be drawn out from the housing 11 of the floor-sweeping machine 10.

The two downwardly directed projections 50 have, at their free ends, end stops for the spring wire 44 which are formed by extensions 51 directed towards one another, so that the spring wire 44 cannot free itself from the downwardly directed projections 50 of the pivoting lever 35.

The spring wire 44 forming the resilient locking device 36 has, at its two free ends 45, angled portions 52 which are directed obliquely downwards and inwards and which merge into angled portions 53 directed inwards. The angled portions 52 thus form slopes 54 by means of which it is possible to press the two combined dirt-collecting containers 24, 25 into the housing 11 of the floor-sweeping machine 10, since by means of the slopes 54 the ends 45 of the spring wire 44 are transferred into the release position during pressing-in. When the two combined dirt-collecting containers 24, 25 are inserted into the housing 11 of the floor-sweeping machine 10, it is therefore unnecessary to actuate the pivoting lever 35.

As already mentioned, the design illustrated is only one example of putting the invention into practice and the latter is not restricted to this. Instead, many other designs and modifications are possible.

We claim:

1. In a floor-sweeping machine of the type including a housing having an opening in the top portion thereof, brush means rotatably mounted in the housing, means for supporting the housing for movement on a surface to be cleaned and means for moving the housing, the combination comprising:

a dirt collecting container removably positioned in the opening;

a lid connected to and covering said container; and means for releasably securing said dirt collecting container in the housing including a lever located in said lid and movable between a locking and an unlocking position, legs extending from said lever in said container and movably mounted on the inside thereof, projections extending from said lever, and resilient locking and unlocking means attached to said lid and having end portions which retractably engage the housing and an intermediate portion which is in sliding contact with said projections so that when said lever is in the unlocking position said projections compress said locking and unlocking means to retract said end portions from the housing.

2. The floor-sweeping machine according to claim 1, wherein said legs have first and second end portions and intermediate portions joining said end portions, said first end portions extending in a direction substantially perpendicular to said lever and said intermediate portions extending substantially parallel to said lever.

3. The floor-sweeping machine according to claim 2 wherein the housing has wall portions and further including a bearing journal positioned on each of said second end portions and mounted on each of said wall portions.

4. The floor-sweeping machine according to claim 1, wherein said lever rests on said lid when said lever is in the locking position and wherein at least a portion of said lever is raised from said lid and a portion of said legs contacts said lid when said lever is in the unlocking position.

5. The floor-sweeping machine according to claim 2, wherein said resilient locking means is a spring wire, and wherein said intermediate portion of said locking means is U-shaped.

6. The floor-sweeping machine according to claim 1, wherein said projections have side surfaces facing one another, said surfaces being sloped.

7. The floor-sweeping machine according to claim 6, wherein the distance between said side surfaces decreases in a direction opposite to said lever.

8. The floor-sweeping machine according to claim 1, wherein said projections have ends, each of which bounds an end stop for receiving said locking and unlocking means when said lever is in the unlocking position.

9. The floor-sweeping machine according to claim 1, wherein said locking means has angled end portions, each of said end portions having a first part which extends obliquely inwardly in a direction opposite to said lid and a second part continuing from said first part and extending inwardly.

10. The floor-sweeping machine according to claim 1 wherein said dirt-collecting container has two sections between which the revolving brush is positioned.

11. In a floor-sweeping machine of the type including a housing having an opening in the top portion thereof, brush means rotatably mounted in the housing, means for supporting the housing for movement on a surface to be cleaned and means for moving the housing, the combination comprising:

a lid covering the top portion and having a lower surface facing the opening when in a mounted position;

a dirt-collecting container attached to said lid and extending into said opening;

resilient locking means mounted on said lid at said lower surface thereof for displacement between a relaxed locking position in which it engages and a tensioned unlocking position in which it disengages the housing, the resiliency of said locking means urging the latter into said locking position; and actuating means mounted in said lid operative for displacing said locking means into said tensioned unlocking position and for releasing said locking means for return into said relaxed locking position.

12. The floor-sweeping machine according to claim 11 further including projections mounted on the lower surface of said actuating means for slidably retaining said locking means when said locking means is urged into said unlocking position.

13. The floor-sweeping machine according to claim 11, wherein said locking means is a spring wire, said wire having a central U-shaped section which engages said projections.

* * * * *